US009771909B2

(12) United States Patent
Pursifull

(10) Patent No.: US 9,771,909 B2
(45) Date of Patent: Sep. 26, 2017

(54) METHOD FOR LIFT PUMP CONTROL

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 129 days.

(21) Appl. No.: 14/558,482

(22) Filed: Dec. 2, 2014

(65) Prior Publication Data

US 2016/0153385 A1 Jun. 2, 2016

(51) Int. Cl.

| | |
|---|---|
| ***F02M 37/04*** | (2006.01) |
| ***F02M 59/10*** | (2006.01) |
| ***F02D 41/38*** | (2006.01) |
| ***F02M 63/02*** | (2006.01) |
| *F02D 41/30* | (2006.01) |
| *F02D 41/40* | (2006.01) |

(52) U.S. Cl.

CPC ..... *F02M 59/102* (2013.01); *F02D 41/3845* (2013.01); *F02D 41/3854* (2013.01); *F02M 63/0285* (2013.01); *F02D 41/3094* (2013.01); *F02D 41/402* (2013.01); *F02D 2041/3881* (2013.01); *F02D 2200/0602* (2013.01); *F02D 2250/02* (2013.01)

(58) Field of Classification Search

CPC ..... F02D 19/0628; F02D 19/0634; F02D 19/0689; F02D 19/0692; F02D 19/084; F02D 2041/3881; F02D 41/3094; F02D 41/3845; F02D 41/3854; F02M 39/02; F02M 59/102; F02M 59/025; Y02T 10/36

USPC ..... 123/299, 506, 446

See application file for complete search history.

(56) References Cited

U.S. PATENT DOCUMENTS

| | | | |
|---|---|---|---|
| 3,822,677 | A | 7/1974 | Reddy |
| 3,967,598 | A | 7/1976 | Rachel |
| 5,477,833 | A | 12/1995 | Leighton |
| 5,878,727 | A | 3/1999 | Huls |
| 5,884,610 | A | 3/1999 | Reddy |

(Continued)

FOREIGN PATENT DOCUMENTS

| | | |
|---|---|---|
| EP | 2434137 B1 | 7/2013 |
| WO | 2014031400 A1 | 2/2014 |

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.

(Continued)

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

Methods and systems are provided for controlling a low pressure pump in port fuel direct injection (PFDI) engines. One method includes, when operating a high pressure pump in a default pressure mode, pulsing the low pressure pump when pressure in a high pressure fuel rail decreases below a threshold. The method further includes, when operating the high pressure pump in a variable pressure mode, pulsing the low pressure pump based on presence of fuel vapor at an inlet of the high pressure pump.

12 Claims, 6 Drawing Sheets

(56) References Cited

U.S. PATENT DOCUMENTS

| | | | | |
|---|---|---|---|---|
| 5,937,826 | A | 8/1999 | Olson et al. | |
| 6,024,064 | A | 2/2000 | Kato et al. | |
| 6,138,638 | A | 10/2000 | Morikawa | |
| 6,142,747 | A | 11/2000 | Rosenau et al. | |
| 6,196,203 | B1 | 3/2001 | Grieve et al. | |
| 6,694,950 | B2 | 2/2004 | Djordjevic | |
| 6,854,321 | B2 | 2/2005 | Amlin | |
| 6,964,262 | B2 | 11/2005 | Hayakawa | |
| 6,988,488 | B2 | 1/2006 | Pursifull et al. | |
| 7,013,872 | B2 * | 3/2006 | Yamazaki | F02D 41/3836 123/431 |
| 7,025,050 | B2 | 4/2006 | Oono et al. | |
| 7,059,313 | B2 | 6/2006 | Lippa | |
| 7,128,057 | B2 | 10/2006 | Wiese et al. | |
| 7,272,485 | B2 | 9/2007 | Amano et al. | |
| 7,640,916 | B2 | 1/2010 | Ulrey et al. | |
| 7,759,010 | B2 | 7/2010 | Hoch | |
| 7,832,375 | B2 | 11/2010 | Dusa et al. | |
| 7,886,720 | B2 | 2/2011 | Graf | |
| 8,061,329 | B2 | 11/2011 | Pursifull et al. | |
| 8,483,932 | B2 | 7/2013 | Pursifull | |
| 8,776,764 | B2 | 7/2014 | Basmaji et al. | |
| 2001/0029925 | A1 | 10/2001 | Ferry et al. | |
| 2002/0170539 | A1 | 11/2002 | Rembold et al. | |
| 2005/0257779 | A1 | 11/2005 | Knight et al. | |
| 2009/0090331 | A1 | 4/2009 | Pursifull | |
| 2009/0188472 | A1 * | 7/2009 | Ulrey | F02D 33/003 123/495 |
| 2010/0332108 | A1 | 12/2010 | Kato et al. | |
| 2011/0106393 | A1 | 5/2011 | Pursifull | |
| 2011/0209687 | A1 | 9/2011 | Schroeder et al. | |
| 2012/0048242 | A1 * | 3/2012 | Surnilla | F02M 39/02 123/497 |
| 2012/0167859 | A1 * | 7/2012 | Basmaji | F02D 19/0605 123/456 |
| 2013/0061830 | A1 | 3/2013 | Hornby et al. | |
| 2013/0138325 | A1 | 5/2013 | Lee | |
| 2014/0109875 | A1 | 4/2014 | Lachaize | |
| 2014/0120440 | A1 | 5/2014 | Nolan et al. | |
| 2014/0224217 | A1 | 8/2014 | Pursifull et al. | |
| 2014/0230794 | A1 | 8/2014 | Surnilla et al. | |
| 2014/0297071 | A1 | 10/2014 | Dudar et al. | |
| 2015/0027416 | A1 | 1/2015 | Brostrom et al. | |

OTHER PUBLICATIONS

Pursifull, Ross D. et al., "High Pressure Fuel Pump Control for Idle Tick Reduction," U.S. Appl. No. 14/042,971, filed Oct. 1, 2013, 34 pages.

Surnilla, Gopichandra et al., "Adaptive Learning of Duty Cycle for a High Pressure Fuel Pump," U.S. Appl. No. 14/099,615, filed Dec. 6, 2013, 44 pages.

Surnilla, Gopichandra et al., "Robust Direct Injection Fuel Pump System," U.S. Appl. No. 14/155,250, filed Jan. 14, 2014, 61 pages.

Pursifull, Ross D. et al., "Method and System for Characterizing a Port Fuel Injector," U.S. Appl. No. 14/192,768, filed Feb. 27, 2014, 44 pages.

Surnilla, Gopichandra et al., "High Pressure Fuel Pumps with Mechanical Pressure Regulation," U.S. Appl. No. 14/243,615, filed Apr. 2, 2014, 53 pages.

Ulrey, Joseph N. et al., "Adjusting Pump Volume Commands for Direct Injection Fuel Pumps," U.S. Appl. No. 14/300,162, filed Jun. 9, 2014, 42 pages.

Ulrey, Joseph N. et al., "Current Pulsing Control Methods for Lift Fuel Pumps," U.S. Appl. No. 14/444,739, filed Jul. 28, 2014, 48 pages.

Pursifull, Ross D., "Method and System for Supplying Liquefied Petroleum Gas to a Direct Fuel Injected Engine," U.S. Appl. No. 14/532,756, filed Nov. 4, 2014, 39 pages.

Pursifull, Ross D., "Method and System for Fuel System Control," U.S. Appl. No. 14/551,906, filed Nov. 24, 2014, 46 pages.

Sanborn, Ethan D. et al., "Identifying Fuel System Degradation," U.S. Appl. No. 14/558,295, filed Dec. 2, 2014, 53 pages.

Ulrey, Joseph N. et al., "Optimizing Intermittent Fuel Pump Control," U.S. Appl. No. 14/558,363, filed Dec. 2, 2014, 44 pages.

Ulrey, Joseph N. et al., "Systems and Methods for Sensing Fuel Vapor Pressure," U.S. Appl. No. 14/558,406, filed Dec. 2, 2014, 43 pages.

Pursifull, Ross D., "Direct Injection Pump Control," U.S. Appl. No. 14/560,497, filed Dec. 4, 2014, 49 pages.

Surnilla, Gopichandra et al., "Methods and Systems for Fixed and Variable Pressure Fuel Injection," U.S. Appl. No. 14/570,546, filed Dec. 15, 2014, 51 pages.

* cited by examiner

METHOD FOR LIFT PUMP CONTROL

FIELD

The present application relates generally to lift pump control in fuel systems in internal combustion engines.

SUMMARY/BACKGROUND

Port fuel direct injection (PFDI) engines include both port injection and direct injection of fuel and may advantageously utilize each injection mode. For example, at higher engine loads, fuel may be injected into the engine using direct fuel injection for improved engine performance (e.g., by increasing available torque and fuel economy). At lower engine loads and during engine starting, fuel may be injected into the engine using port fuel injection to provide improved fuel vaporization for enhanced mixing and to reduce engine emissions. Further, port fuel injection may provide an improvement in fuel economy over direct injection at lower engine loads. The enhanced fuel economy may be ascribed to a reduction in pumping work due to a higher manifold pressure (via fuel vapor pressure) and a more complete combustion due to better mixing of fuel and air. Further still, noise, vibration, and harshness (NVH) may be reduced when operating with port injection of fuel. In addition, both port injectors and direct injectors may be operated together under some conditions to leverage advantages of both types of fuel delivery or in some instances, differing fuels.

In PFDI engines, a lift pump (also termed, low pressure pump) supplies fuel from a fuel tank to both port fuel injectors and a direct injection fuel pump. The direction injection fuel pump may supply fuel at a higher pressure to direct injectors. The direct injection (DI) fuel pump may not be activated during certain periods of engine operation (e.g., during port fuel injection at low engine loads) which may affect lubrication of the DI fuel pump and increase wear, NVH, and degradation of the DI fuel pump. To reduce DI fuel pump degradation and improve lubrication, PFDI engines may continue direct injecting fuel at engine idle conditions. However, this operation can result in excessive NVH from ticks generated by actuation of a solenoid activated check valve in the DI fuel pump. These ticks may be audible to a vehicle operator and passengers due to a lack of engine noise to mask the DI fuel pump noise during idling conditions. To counter ticking noises during idling, the DI fuel pump may be operated in a default pressure mode by deactivating the solenoid activated check valve. Additionally, pump pressure and fuel rail pressure may be mechanically regulated, during lower engine loads, in the default pressure mode.

The DI fuel pump may be operated in two distinct, albeit, potentially overlapping, modes: the default pressure mode and a variable pressure mode. As such, the solenoid activated check valve may be activated in the variable pressure mode and may be deactivated in the default pressure mode.

The DI fuel pump may function as a pressure regulator and may continually regulate fuel rail pressure in a high pressure fuel rail, whether the solenoid activated check valve is in a deactivated or activated condition. Herein, the DI fuel pump may regulate fuel pressure in the high pressure fuel rail by adding fuel to the high pressure fuel rail if the fuel rail pressure is below a predetermined threshold. When the fuel rail pressure is above the predetermined threshold, this pressure regulation feature of the DI fuel pump may be inactive. As such, the control of fuel rail pressure may be entirely mechanical-hydraulic in nature.

When the solenoid activated check valve is activated, the DI fuel pump may function as a fuel volume regulator. The fuel volume regulator feature in the DI fuel pump may add a given volume of fuel to the high pressure fuel rail depending on a command from a controller sent to the solenoid activated check valve. Normally, this command may be based on a comparison of a reading from a fuel rail pressure sensor to a desired fuel rail pressure. Nonetheless, the DI fuel pump mechanism may effectively regulate fuel volume when the solenoid activated check valve is activated. Accordingly, the DI fuel pump may also be termed a fuel volume metering device.

The inventors herein have recognized potential issues with controlling lift pump operation. For example, lift pump operation may be based on a comparison between an actual (or observed) and expected DI fuel pump volumetric efficiency. However, this approach to lift pump control may only be suitable when the DI fuel pump is functioning as a fuel volume metering device. In other words, a method of lift pump control used during the variable pressure mode of the DI fuel pump may not be suitable for default pressure mode operation of the DI fuel pump.

In another example, during default pressure mode operation of the DI fuel pump, the low pressure pump may be operated continuously. As such, conventional methods of controlling the low pressure pump during the default pressure mode expend excessive pump power, thereby reducing fuel economy and pump durability. Further, operational and maintenance costs of the lift pump may be increased.

The inventors herein have recognized the above issues and identified an approach to at least partly address the above issues. In one example approach a method of operating a low pressure pump is provided. The method comprises, when operating a high pressure pump in a default pressure mode, pulsing a low pressure pump when pressure in a high pressure fuel rail decreases below a threshold, and when operating the high pressure pump in a variable pressure mode, pulsing the low pressure pump based on presence of fuel vapor at an inlet of the high pressure pump. In this way, the low pressure pump is actuated only when certain conditions prevail, reducing energy consumption.

For example, a DI fuel pump of a fuel system in a PFDI engine may be operated in one of two modes: a default pressure mode and a variable pressure mode. An electronically controlled solenoid activated inlet check valve may be activated, and maintained active, during the variable pressure mode. In the default pressure mode, the electronically controlled solenoid activated inlet check valve may be deactivated and the DI fuel pump may be operated with a constant default pressure. As such, a pressure relief valve may regulate pressure in a compression chamber of the DI fuel pump to a default pressure based on a setting of the pressure relief valve. Further, pressure in a fuel rail coupled to the DI fuel pump may be monitored by a pressure sensor. As such, low pressure pump operation may be controlled based on readings from the pressure sensor. In addition, low pressure pump operation during the default pressure mode of the DI fuel pump may be particularly based on pressure readings learned during one or more compression strokes in the DI fuel pump. Accordingly, when the DI fuel pump is operating in default pressure mode and pressure in the fuel rail during one or more compression strokes drops below a threshold, the low pressure pump may be pulsed at full voltage to increase pressure in the fuel rail. Alternatively, the low pressure pump may be pulsed for a specific time duration.

When the DI fuel pump is operating in variable pressure mode, the lift pump may be pulsed based on presence of fuel vapor at an inlet of the DI fuel pump. Fuel vapor may be sensed when a compression stroke in the DI fuel pump does not cause an expected corresponding increase in pressure in the fuel rail. In response to the detection of vapor at DI fuel pump inlet, the lift pump may be pulsed at full voltage to increase fuel rail pressure.

In this way, lift pump operation may be controlled for multiple benefits. The lift pump may be pulsed at full voltage or for short predetermined durations to enable a faster increase in fuel rail pressure. By actuating the lift pump only under certain conditions, lift pump energy consumption may be reduced leading to an increase in fuel economy which in turn can ease operating expenses. Further, durability of the lift pump may be extended, and maintenance costs of the lift pump may be decreased. Overall, operation of the lift pump may be improved and more efficient.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

In port fuel direct injection (PFDI) engines, a fuel delivery system may include multiple fuel pumps for providing a desired fuel pressure to the fuel injectors. As one example, the fuel delivery system may include a lower pressure fuel pump (or lift pump) and a higher pressure (or direct injection) fuel pump arranged between a fuel tank and fuel injectors. The higher pressure fuel pump may be coupled to upstream of a high pressure fuel rail in a direct injection system to raise a pressure of the fuel delivered to engine cylinders through direct injectors. A solenoid activated inlet check valve, or spill valve, may be coupled upstream of the high pressure (HP) pump to regulate fuel flow into a compression chamber of the high pressure pump. The spill valve is commonly electronically controlled by a controller which may be part of a control system for the engine of the vehicle. Furthermore, the controller may also have a sensory input from a sensor, such as an angular position sensor, that allows the controller to command activation of the spill valve in synchronism with a driving cam that powers the high pressure pump.

Figure 1:
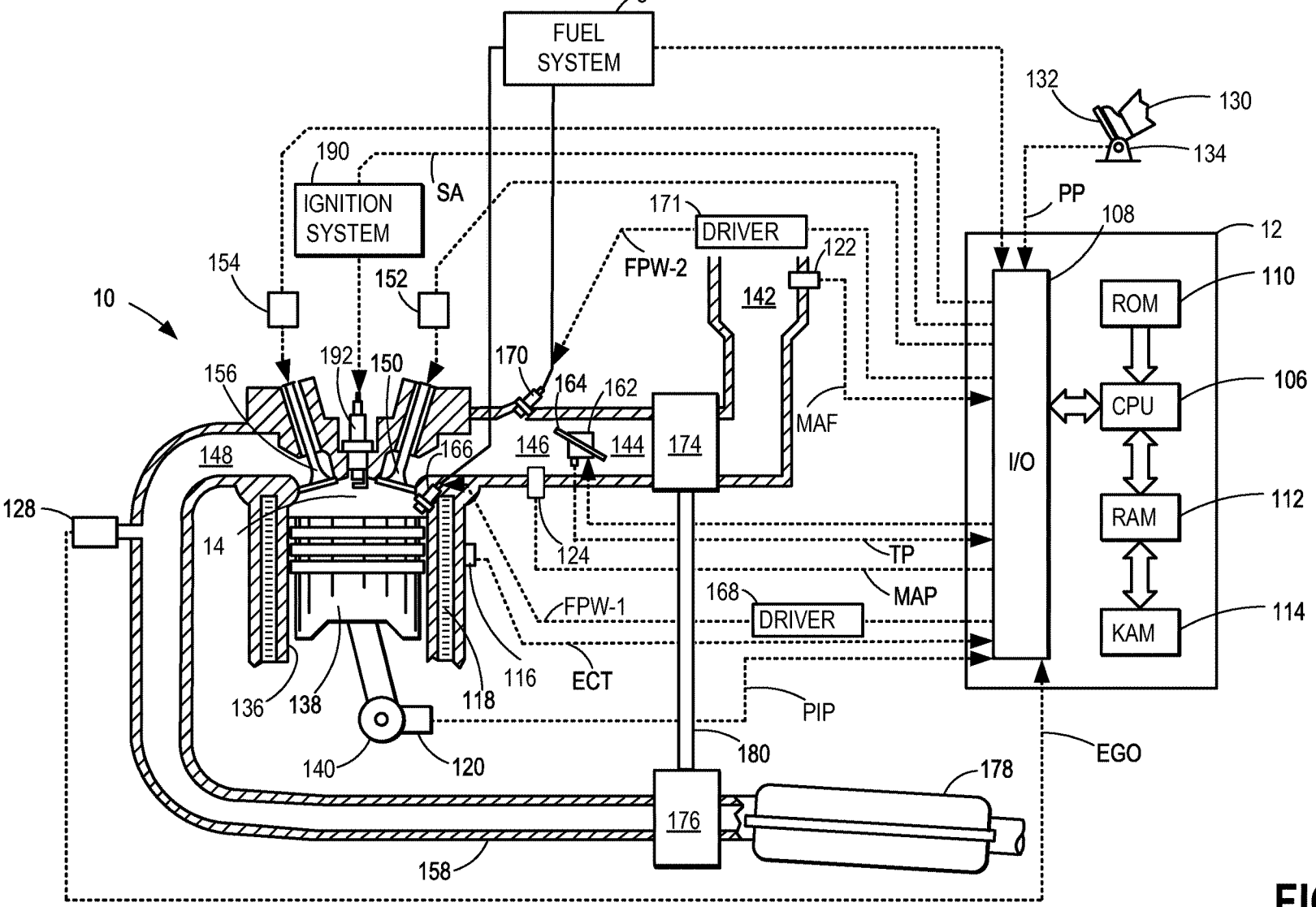
FIG. 1 schematically depicts an example embodiment of a cylinder in an internal combustion engine.
Figure 2:
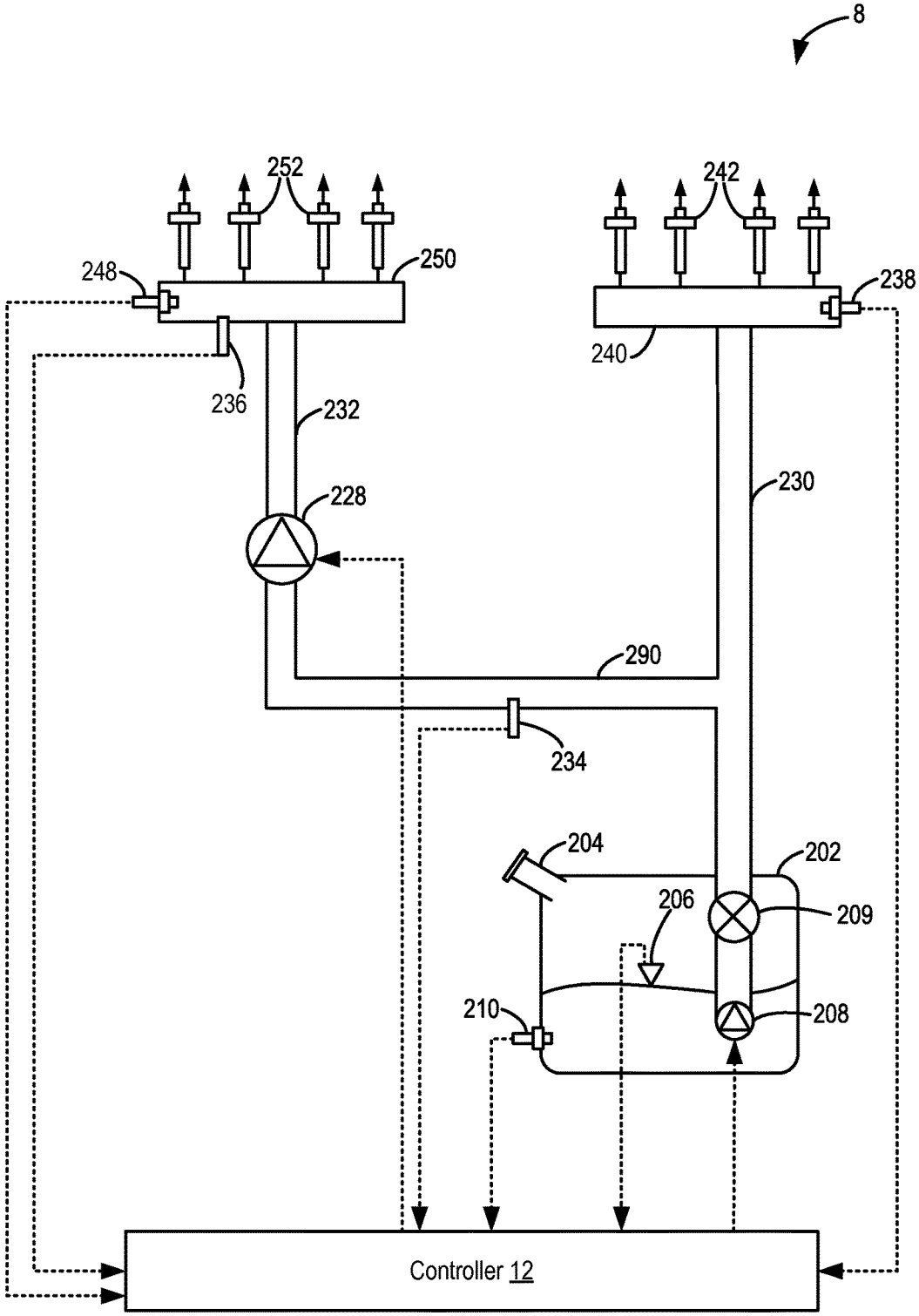
FIG. 2 schematically illustrates an example embodiment of a fuel system that may be used in the engine of FIG. 1.
Figure 4:
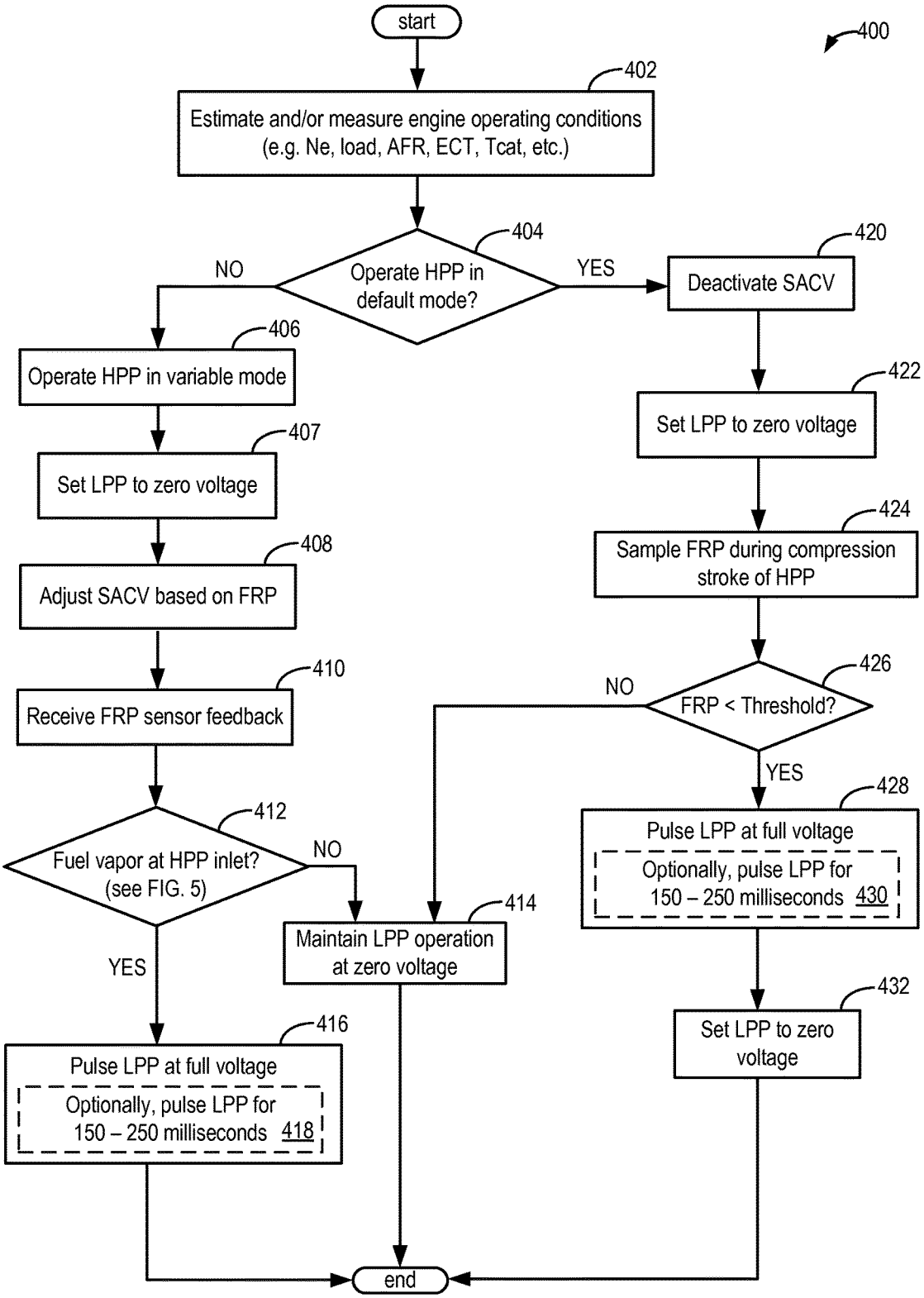
FIG. 4 demonstrates an example flow chart illustrating a method for controlling operation of a low pressure pump based on operating modes of the high pressure pump, in accordance with the present disclosure.
Figure 5:
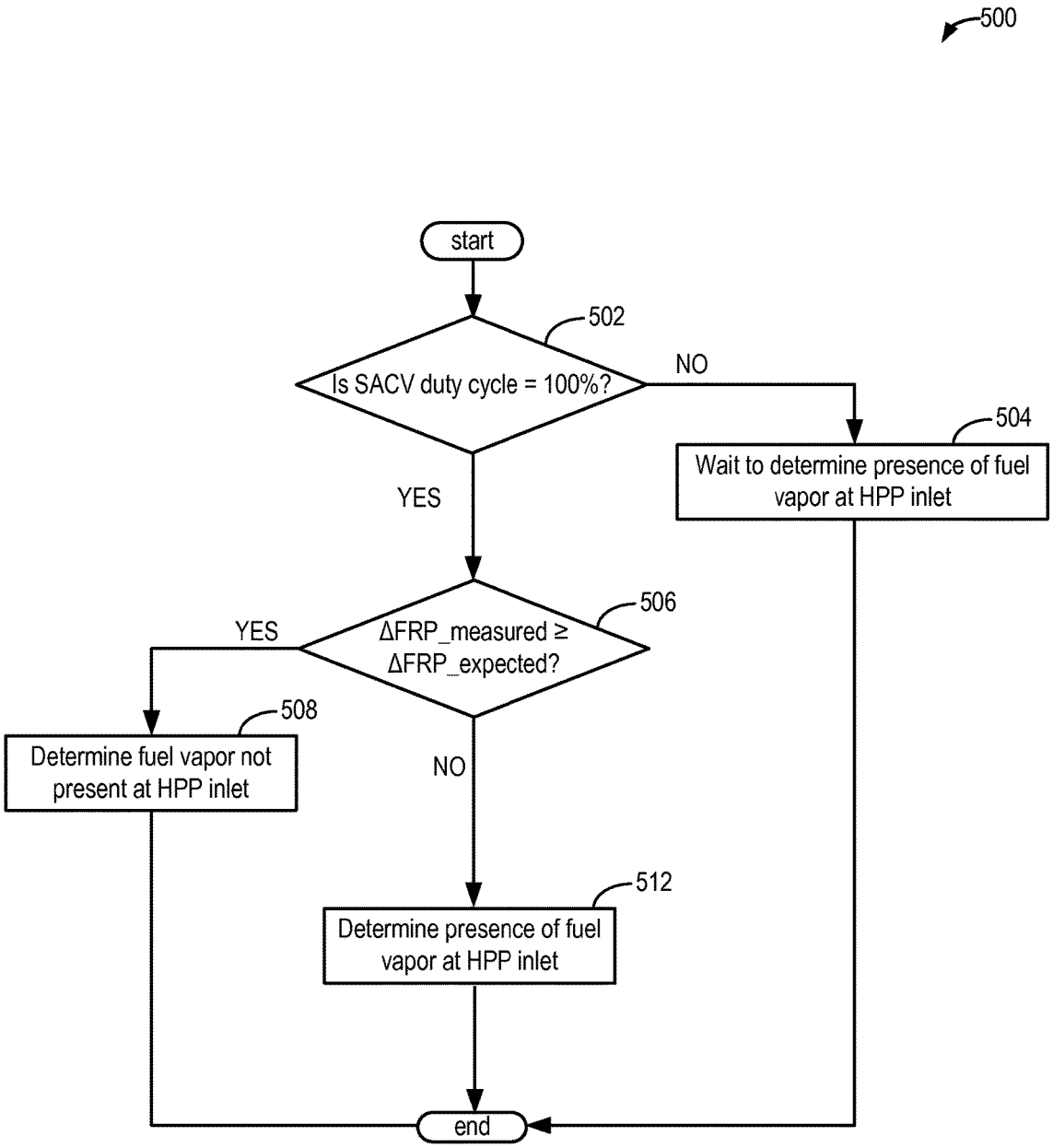
FIG. 5 shows an example flow chart for determining presence of fuel vapor at an inlet of the high pressure pump.
Figure 6:
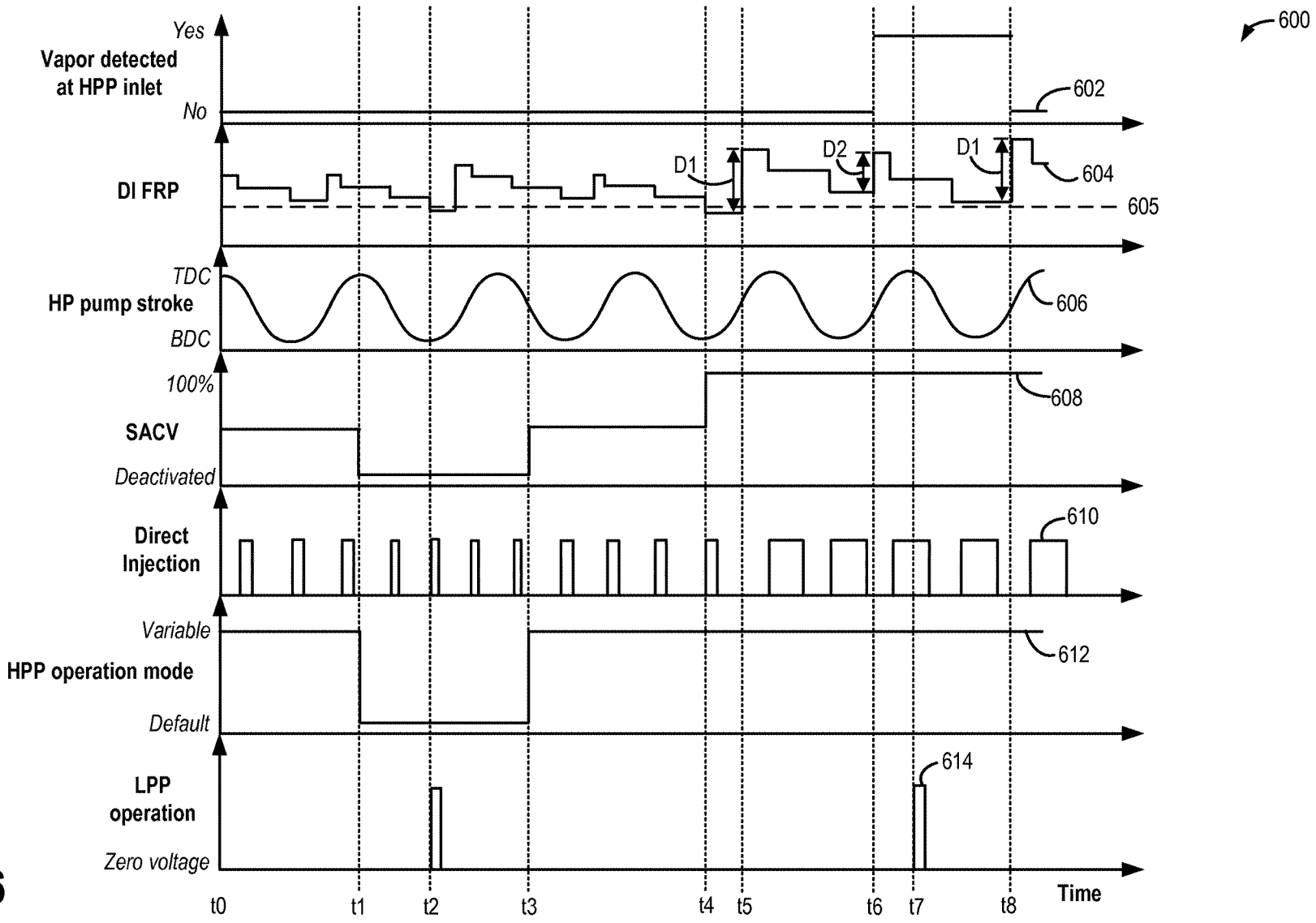
FIG. 6 depicts an example operation of the lift pump, in accordance with the present disclosure.

The following description provides information regarding controlling a low pressure pump in a fuel system, such as the example fuel system of FIG. 2, within an engine system, such as the engine system of FIG. 1. The fuel system may include a high pressure pump (FIG. 3) in addition to the low pressure pump. The high pressure pump may be operated either in a variable pressure mode or in a default pressure mode. Further, operation of the low pressure pump may be based on the mode of operation of the high pressure pump (FIG. 4). The low pressure pump may be pulsed in a default pressure mode of the high pressure pump only when fuel rail pressure in a high pressure fuel rail falls below a predetermined threshold (FIG. 6). When the high pressure pump is operating in a variable pressure mode, the low pressure pump may be pulsed when fuel vapor is detected at an inlet of the high pressure pump (FIGS. 5, 6). In this way, a duration of operation of the low pressure pump may be reduced such that it is pulsed only when select conditions are met, enabling a reduction in power consumption.

Regarding terminology used throughout this detailed description, a high pressure pump, or direct injection fuel pump, may be abbreviated as a HP pump (alternatively, HPP) or a DI fuel pump respectively. Accordingly, HPP and DI fuel pump may be used interchangeably to refer to the high pressure direct injection fuel pump. Similarly, a low pressure pump, may also be referred to as a lift pump. Further, the low pressure pump may be abbreviated as LP pump or LPP. Port fuel injection may be abbreviated as PFI while direct injection may be abbreviated as DI. Also, fuel rail pressure, or the value of pressure of fuel within the fuel rail (most often the direct injection fuel rail), may be abbreviated as FRP. The direct injection fuel rail may also be referred to as a high pressure fuel rail, which may be abbreviated as HP fuel rail. Also, the solenoid activated inlet check valve for controlling fuel flow into the HP pump may be referred to as a spill valve, a solenoid activated check valve (SACV), electronically controlled solenoid activated inlet check valve, and also as an electronically controlled valve. Further, when the solenoid activated inlet check valve is activated, the HP pump is referred to as operating in a variable pressure mode. Further, the solenoid activated check valve may be maintained in its activated state throughout the operation of the HP pump in variable pressure mode. If the solenoid activated check valve is deactivated and the HP pump relies on mechanical pressure regulation without any commands to the electronically-controlled spill valve, the HP pump is referred to as operating in a mechanical mode or in a default pressure mode. Further, the solenoid activated check valve may be maintained in its deactivated state throughout the operation of the HP pump in default pressure mode.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated in FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake air passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel from a fuel tank 202 to direct fuel injectors 252 and port injectors 242 of an engine, such as engine 10 of FIG. 1. Fuel system 8 may be operated by a controller, such as controller 12 of FIG. 1, to perform some or all of the operations described with reference to the example routines depicted in FIGS. 4 and 5.

Fuel system 8 can provide fuel to an engine, such as example engine 10 of FIG. 1, from a fuel tank 202. By way of example, the fuel may include one or more hydrocarbon components, and may also include an alcohol component. Under some conditions, this alcohol component can provide knock suppression to the engine when delivered in a suitable amount, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost. As a specific non-limiting example, fuel may include gasoline and ethanol, (e.g., E10, and/or E85). Fuel may be provided to fuel tank 202 via fuel filling passage 204.

A low pressure fuel pump 208 (herein, also termed lift pump 208) in communication with fuel tank 202 may be operated to supply fuel from fuel tank 202 to a first group of port injectors 242, via a first fuel passage 230. Lift pump 208 may also be referred to as LPP 208, or a LP (low pressure) pump 208. In one example, LPP 208 may be an electrically-powered lower pressure fuel pump disposed at least partially within fuel tank 202. Fuel lifted by LPP 208 may be supplied at a lower pressure into a first fuel rail 240 coupled to one or more fuel injectors of first group of port injectors 242 (herein also referred to as first injector group). An LPP check valve 209 may be positioned at an outlet of the LPP. LPP check valve 209 may direct fuel flow from LPP 208 to first fuel passage 230 and second fuel passage 290, and may block fuel flow from first and second fuel passages 230 and 290 respectively back to LPP 208.

While first fuel rail 240 is shown dispensing fuel to four fuel injectors of first group of port injectors 242, it will be appreciated that first fuel rail 240 may dispense fuel to any suitable number of fuel injectors. As one example, first fuel rail 240 may dispense fuel to one fuel injector of first group of port injectors 242 for each cylinder of the engine. Note that in other examples, first fuel passage 230 may provide fuel to the fuel injectors of first group of port injectors 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 (or DI pump 228 or high pressure pump 228) is included in second fuel passage 232 and may receive fuel via LPP 208. In one example, direct injection fuel pump 228 may be a mechanically-powered positive-displacement pump. Direct injection fuel pump 228 may be in communication with a group of direct fuel injectors 252 via a second fuel rail 250. Second fuel rail 250 may be a high (or higher) pressure fuel rail. Direct injection fuel pump 228 may further be in fluidic communication with first fuel passage 230 via second fuel passage 290. Thus, fuel at lower pressure lifted by LPP 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in fuel tank 202 via fuel level sensor 206. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel tank 202 may be provided by fuel composition sensor 210. Fuel composition sensor 210 may further comprise a fuel temperature sensor. Additionally or alternatively, one or more fuel composition sensors may be provided at any suitable location along the fuel passages between the fuel storage tank and the two fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, fuel composition sensors 238 and 248, arranged at the fuel rails or along the fuel passages coupling the fuel injectors with fuel tank 202, can provide an indication of a fuel composition before being delivered to the engine. In contrast, fuel composition sensor 210 may provide an indication of the fuel composition at the fuel tank 202.

Fuel system 8 may also comprise pressure sensor 234 coupled to second fuel passage 290, and pressure sensor 236 coupled to second fuel rail 250. Pressure sensor 234 may be used to determine a fuel line pressure of second fuel passage 290 which may correspond to a delivery pressure of low pressure pump 208. Pressure sensor 236 may be positioned downstream of DI fuel pump 228 in second fuel rail 250 and may be used to measure fuel rail pressure (FRP) in second fuel rail 250. Additional pressure sensors may be positioned in fuel system 8 such as at the first fuel rail 240 to measure the pressure therein. Sensed pressures at different locations in fuel system 8 may be communicated to controller 12.

LPP 208 may be used for supplying fuel to both the first fuel rail 240 during port fuel injection and the DI fuel pump 228 during direct injection of fuel. During both port fuel injection and direct injection of fuel, LPP 208 may be controlled by controller 12 to supply fuel to the first fuel rail 240 and/or the DI fuel pump 228 based on fuel rail pressure in each of first fuel rail 240 and second fuel rail 250. In one example, during port fuel injection, controller 12 may control LPP 208 to operate in a continuous mode to supply fuel at a constant fuel pressure to first fuel rail 240 so as to maintain a relatively constant port fuel injection pressure.

On the other hand, during direct injection of fuel when port fuel injection is OFF and deactivated, controller 12 may control LPP 208 to supply fuel to the DI fuel pump 228. During direct injection of fuel when port fuel injection is OFF, and when the pressure in second fuel passage 290 remains greater than a current fuel vapor pressure, LPP 208 may be temporarily switched OFF without affecting DI fuel injector pressure. Further, LPP 208 may be operated in a pulsed mode, where the LPP is alternately switched ON and OFF based on fuel pressure readings from pressure sensor 236 coupled to second fuel rail 250.

While the LPP may be operated in continuous mode during PFI mode, a pulsed mode of LP pump operation may be used during DI operation. In an alternate embodiment, LPP 208 may be operated in pulsed mode during both PFI and DI engine operations to benefit from reduced power consumption of the lift pump when operated in the pulsed mode. As such, LPP 208 may be pulsed without feedback similar to LPP operation in continuous mode (with continuous voltage supply at a non-zero voltage) without feedback. If feedback is not available, LPP 208 may be operated with slightly higher power than required. However, despite the slightly higher power provided to the LPP 208 during pulsed mode operation without feedback, the LPP may effectively consume significantly lower power in the pulsed mode.

In a PFDI engine where the DI pump is operating in default pressure mode, feedback on PFI fuel rail pressure (e.g. fuel pressure in first fuel rail 240 in FIG. 2) may be used for lift pump control whether the lift pump is operated in pulsed mode or continuous mode. For direct injection and DI fuel rail pressure (e.g. second fuel rail 250 in FIG. 2), though, feedback on DI pump volumetric efficiency may be used.

In another example, in the pulsed mode, LPP 208 may be activated (as in, turned ON) but may be set at zero voltage. As such, this setting for LPP 208 may effectively ensure lower energy consumption by LPP 208 while providing a faster response time when LPP 208 is actuated. When low pressure pump operation is desired, voltage supplied to LPP 208 may be increased from zero voltage to enable LP pump operation. Thus, LPP 208 may be pulsed from a zero voltage to a non-zero voltage. In one example, LPP 208 may be pulsed from zero voltage to full voltage. In another example, LPP 208 may be pulsed for short intervals such as 50 to 250 milliseconds at a non-zero voltage. A distinct voltage may be used based on duration of the short intervals. For example, LPP 208 may be pulsed at 8 V when the short interval is between 0 to 50 milliseconds. Alternatively, if the duration of the short interval is 50 to 100 milliseconds, LPP 208 may be pulsed at 10 V. In another example, LPP 208 may be pulsed at 12 V when the interval is between 100 and 250 milliseconds. As such, during these intervals current to a pump electronic module (PEM) may be limited. The PEM, in turn, may supply electrical power to an electric motor coupled to the fuel pump (e.g. LPP 208).

It will be appreciated that by operating LPP 208 in the pulsed mode, a saw tooth pressure pattern may be observed in pressure output. For example, the pulsed mode may generate a quick rise in pressure to 6.5 bar followed by a ramp down to 4.5 bar as fuel is consumed. While this change in pressure may not be used in direct injection systems, knowledge of current pressure may be desired in PFI systems.

It will also be appreciated that though the above example of pulsed mode operation of LPP 208 is described for engine conditions when port injection may be deactivated and turned OFF, the LPP 208 may be operated in pulsed mode when both, direct injection and port injection are actuated.

LPP 208 and the DI fuel pump 228 may be operated to maintain a prescribed fuel rail pressure in second fuel rail 250. Pressure sensor 236 coupled to the second fuel rail 250 may be configured to provide an estimate of the fuel pressure available at the group of direct injectors 252. Then, based on a difference between the estimated rail pressure and a desired rail pressure, each of the pump outputs may be adjusted. In one example, where the DI fuel pump 228 is operating in a variable pressure mode, the controller 12 may adjust a flow control valve (e.g., solenoid activated check valve) of the DI fuel pump 228 to vary the effective pump volume (e.g., pump duty cycle) of each pump stroke. Further, LPP 208 may largely be activated with zero voltage and may be pulsed at a non-zero voltage only when fuel vapor is detected at an inlet of the DI fuel pump 228.

In another example, LPP 208 may be operated in pulsed mode to maintain a fuel rail pressure (FRP) in the second fuel rail 250 when DI fuel pump 228 is operated in default pressure mode. Herein, LPP 208 may be pulsed at full voltage when one or more pressure readings sensed by pressure sensor 236 during the compression stroke of DI fuel pump 228 are lower than a threshold pressure. As such, a plurality of pressure readings sensed only during compression strokes in the DI fuel pump 228 may be utilized. Further, in one example, an average of the plurality of readings may be obtained and if the average is below the threshold pressure, LPP 208 may be pulsed with a non-zero voltage.

Lift pump operation may be based on feedback of either fuel rail pressure in the DI fuel rail 250 or volumetric efficiency of the DI pump. With pressure feedback, lift pump operation may be based on an assumption of a highly volatile fuel. With feedback on volumetric efficiency, lift pump operation may not be based on either assumption of a low efficiency pump or a highly volatile fuel. Thus, with feedback on volumetric efficiency, the lift pump may be pulsed at a pressure required to maintain the fuel in liquid state. Pulsing the pump may also improve power consumption over continuously powering the lift pump with a substantially constant electrical power. Operation of LPP 208 in a pulsed mode may therefore be advantageous because it offers energy savings and improves durability of LPP 208.

Controller 12 can also control the operation of each of fuel pumps LPP 208 and DI fuel pump 228 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. As one example, a DI fuel pump duty cycle may refer to a fractional amount of a full DI fuel pump volume to be pumped. Thus, a 10% DI fuel pump duty cycle may represent energizing a solenoid activated check valve such that 10% of the DI fuel pump volume may be pumped. A driver (not shown) electronically coupled to controller 12 may be used to send a control signal to LPP 208, as required, to adjust the output (e.g. speed, delivery pressure) of the LPP 208. The amount of fuel that is delivered to the group of direct injectors via the DI fuel pump 228 may be adjusted by adjusting and coordinating the output of the LPP 208 and the DI fuel pump 228. For example, controller 12 may control the LPP 208 through a feedback control scheme by measuring the low pressure pump delivery pressure in second fuel passage 290 (e.g., with pressure sensor 234) and controlling the output of the LPP 208 in accordance with achieving a desired (e.g. set point) low pressure pump delivery pressure.

Figure 3:
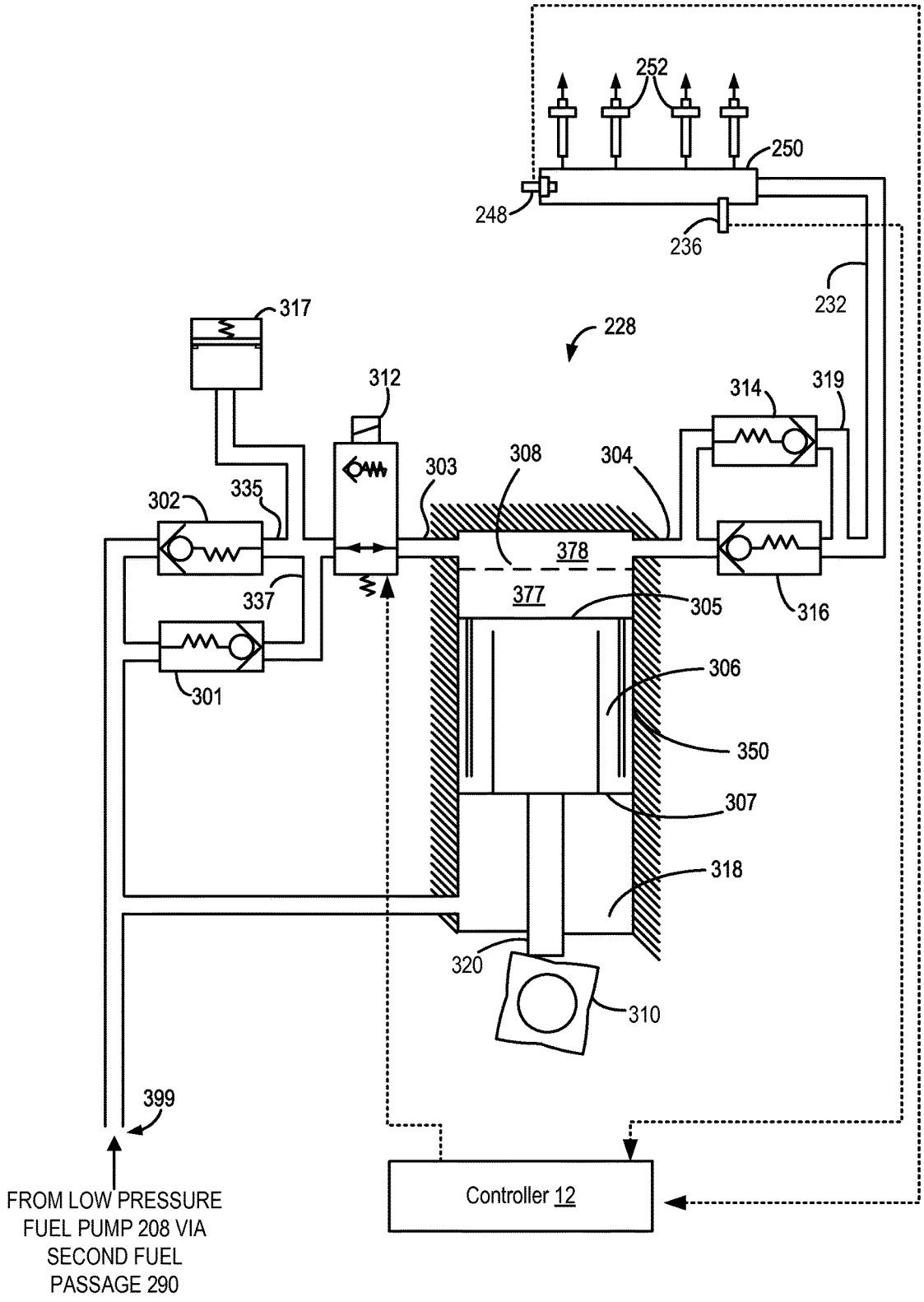
FIG. 3 presents an example embodiment of a high pressure pump.

FIG. 3 illustrates example DI fuel pump 228 shown in the fuel system 8 of FIG. 2. As mentioned earlier in reference to FIG. 2, DI pump 228 receives fuel at a lower pressure from LPP 208 via second fuel passage 290. Further, DI pump 228 pressurizes the fuel to a higher pressure before pumping the fuel to second group of injectors 252 (or direct injectors) via second fuel passage 232.

Inlet 303 of compression chamber 308 in DI pump 228 is supplied fuel via low pressure fuel pump 208 as shown in FIGS. 2 and 3. The fuel may be pressurized upon its passage through direct injection fuel pump 228 and may be supplied to second fuel rail 250 and direct injectors 252 through pump outlet 304. In the depicted example, direct injection pump 228 may be a mechanically-driven displacement pump that includes a pump piston 306 and piston rod 320, a pump compression chamber 308 (herein also referred to as compression chamber), and a step-room 318. Assuming that piston 306 is at a bottom dead center (BDC) position in FIG. 3, the pump displacement may be represented as displacement volume 377. The displacement of the DI pump may be measured as the area swept by piston 306 as it moves from top dead center (TDC) to BDC or vice versa. A second volume also exists within compression chamber 308, the second volume being a clearance volume 378 of the pump. The clearance volume defines the region in compression chamber 308 that remains when piston 306 is at TDC. In other words, the addition of displacement volume 377 and clearance volume 378 form compression chamber 308.

Piston 306 includes a piston top 305 and a piston bottom 307. The step-room and compression chamber may include cavities positioned on opposing sides of the pump piston. In one example, driving cam 310 may be in contact with piston rod 320 of the DI pump 228 and may be configured to drive piston 306 from BDC to TDC and vice versa, thereby creating the motion necessary to pump fuel through compression chamber 308. Driving cam 310 includes four lobes and completes one rotation for every two engine crankshaft rotations.

Piston 306 reciprocates up and down within compression chamber 308 to pump fuel. DI fuel pump 228 is in a compression stroke when piston 306 is traveling in a direction that reduces the volume of compression chamber 308. Conversely, direct fuel injection pump 228 is in a suction stroke when piston 306 is traveling in a direction that increases the volume of compression chamber 308.

A solenoid activated check valve (SACV) 312 is positioned upstream of inlet 303 to compression chamber 308 of DI pump 228. Controller 12 may be configured to regulate fuel flow through solenoid activated check valve 312 by energizing or de-energizing a solenoid within solenoid activated check valve 312 (based on the solenoid valve configuration) in synchronism with the driving cam 310. Accordingly, solenoid activated check valve 312 may be operated in two modes. In a first mode, solenoid activated check valve 312 is actuated to limit (e.g. inhibit) the amount of fuel traveling upstream of the solenoid activated check valve 312. In the first mode, fuel may flow substantially from upstream of solenoid activated check valve 312 to downstream of solenoid activated check valve 312. In a second mode, solenoid activated check valve 312 is effectively disabled and fuel can travel both upstream and downstream of solenoid activated check valve 312. While solenoid activated check valve 312 has been described as above, it also can be implemented as a solenoid plunger that forces a check valve open when de-energized. This plunger design may have an additional advantage of being able to de-energize the solenoid once pressure builds in the compression chamber 308, thus holding the check valve closed.

As mentioned earlier, solenoid activated check valve 312 may be configured to regulate the mass (or volume) of fuel compressed within DI fuel pump 228. In one example, controller 12 may adjust a closing timing of the solenoid activated check valve to regulate the mass of fuel compressed. For example, closing the solenoid activated check valve 312 at a later time relative to piston compression (e.g. volume of compression chamber is decreasing) may reduce the amount of fuel mass delivered from the compression chamber 308 to pump outlet 304 since more of the fuel displaced from the compression chamber 308 can flow through the solenoid activated check valve 312 before it closes. In contrast, an early inlet check valve closing relative to piston compression may increase the amount of fuel mass delivered from the compression chamber 308 to the pump outlet 304 since less of the fuel displaced from the compression chamber 308 can flow (in reverse direction) through the electronically controlled check valve 312 before it closes. Opening and closing timings of the solenoid activated check valve 312 may be coordinated with stroke timings of the DI fuel pump 228. Alternately or additionally, by continuously throttling fuel flow into the DI fuel pump from the low pressure fuel pump, fuel ingested into the direct injection fuel pump may be regulated without use of SACV 312.

Pump inlet 399 may receive fuel from an outlet of LPP 208 and may direct the fuel to solenoid activated check valve 312 via check valve 302 and pressure relief valve 301. Check valve 302 is positioned upstream of solenoid activated check valve 312 along pump passage 335. Check valve 302 is biased to prevent fuel flow out of solenoid activated check valve 312 and pump inlet 399. Check valve 302 allows fuel flow from the low pressure pump 208 to solenoid activated check valve 312. Check valve 302 is coupled in parallel with pressure relief valve 301. Pressure relief valve 301 coupled in relief passage 337 allows fuel flow out of solenoid activated check valve 312 toward the low pressure fuel pump 208 when pressure between pressure relief valve 301 and solenoid activated check valve 312 is greater than a predetermined pressure (e.g., 10 bar).

When solenoid activated check valve 312 is deactivated (e.g., not electrically energized), and DI fuel pump 228 is operating in the default pressure mode, solenoid activated check valve 312 operates in a pass-through mode and pressure relief valve 301 regulates pressure in compression chamber 308 to the single pressure relief setting of pressure relief valve 301 (e.g., 15 bar). Regulating the pressure in compression chamber 308 allows a pressure differential to form from piston top 305 to piston bottom 307. The pressure in step-room 318 is at the pressure of the outlet of the low pressure pump (e.g., 5 bar) while the pressure at piston top is at a regulation pressure of pressure relief valve 301 (e.g., 15 bar). The pressure differential allows fuel to seep from piston top 305 to piston bottom 307 through the clearance between piston 306 and pump cylinder wall 350, thereby lubricating direct injection fuel pump 228.

Thus, during conditions when DI fuel pump operation is regulated mechanically, controller 12 may deactivate solenoid activated inlet check valve 312 and pressure relief valve 301 regulates pressure in fuel rail 250 (and compression chamber 308) to a single substantially constant (e.g., regulation pressure ±0.5 bar) pressure during most of the compression stroke. On the intake stroke of piston 306, the pressure in compression chamber 308 drops to a pressure near the pressure of the lift pump 208. One result of this regulation method is that the fuel rail is regulated to a minimum pressure approximately the pressure relief of pressure relief valve 301. Thus, if pressure relief valve 301 has a pressure relief setting of 15 bar, the fuel rail pressure in second fuel rail 250 becomes 20 bar because the pressure relief setting of 15 bar is added to the 5 bar of lift pump pressure. Specifically, the fuel pressure in compression chamber 308 is regulated during the compression stroke of direct injection fuel pump 228. It will be appreciated that the solenoid activated check valve 312 is maintained deactivated throughout the operation of the DI fuel pump 228 in the default pressure mode.

Operation of the solenoid activated check valve 312 (e.g., when energized) may result in increased NVH because cycling the solenoid activated check valve 312 may generate ticks as the valve is seated or is fully opened against the fully open valve limit. Furthermore, when the solenoid activated check valve 312 is de-energized to pass through mode, NVH arising from valve ticks may be substantially reduced. As an example, the solenoid activated check valve 312 may be de-energized and the DI pump may be operated in default pressure mode when the engine is idling since during engine idling conditions, fuel is largely injected via port fuel injection. As such, operation of lift pump 208 during the default mode of DI fuel pump 228 will be further described in reference to FIG. 4 below.

A forward flow outlet check valve 316 may be coupled downstream of pump outlet 304 of the compression chamber 308 of DI fuel pump 228. Outlet check valve 316 opens to allow fuel to flow from the outlet 304 of compression chamber 308 into second fuel rail 250 only when a pressure at the pump outlet 304 of direct injection fuel pump 228 (e.g., a compression chamber outlet pressure) is higher than the fuel rail pressure. In another example DI fuel pump, inlet port 303 to compression chamber 308 and outlet port 304 may be the same port.

A fuel rail pressure relief valve 314 is located parallel to outlet check valve 316 in a parallel passage 319 that branches off from second fuel passage 232. Fuel rail pressure relief valve 314 may allow fuel flow out of fuel rail 250 and passage 232 into compression chamber 308 when pressure in parallel passage 319 and second fuel passage 232 exceeds a predetermined pressure, where the predetermined pressure may be a relief pressure setting of valve 314. As such, fuel rail pressure relief valve 314 may regulate pressure in fuel rail 250. Fuel rail pressure relief valve 314 may be set at a relatively high relief pressure such that it acts only as a safety valve that does not affect normal pump and direct injection operation.

Direct injection fuel pump 228 also includes a pressure accumulator 317 positioned along pump passage 335 between solenoid activated check valve 312 and check valve 302. In one example, pressure accumulator 317 is a 15 bar accumulator. Thus, pressure accumulator 317 is designed to be active in a pressure range that straddles the pressure relief valve 301. Pressure accumulator 317 stores fuel when piston 306 is in a compression stroke and releases fuel when piston 306 is in a suction stroke. Pressure relief valve 301 and pressure accumulator 317 store and release fuel from compression chamber 308 when solenoid activated check valve 312 is deactivated (acting as a pass-through opening) and DI fuel pump 228 is in default pressure mode. Pressure accumulator 317 may also apply a positive pressure across the piston 306 during a portion of the piston intake (suction) stroke, further enhancing Poiseuille lubrication. In addition, a portion of compression energy from the positive pressure applied by pressure accumulator 317 on piston 306 may be transferred to a camshaft of driving cam 310. Further, the action of pressure accumulator 317 may reduce flow through pressure relief valve 301, thus reducing fuel heating, which may raise fuel temperature and increase lift pump power demand.

It will be appreciated that LPP 208 may be operated in pulsed mode which includes maintaining LPP 208 at a zero voltage and pulsing LPP 208 between a zero voltage and a non-zero voltage (e.g. full voltage) when certain conditions are met. For example, when the DI fuel pump 228 is in the default pressure mode, LPP 208 may be pulsed with a non-zero voltage only when FRP in high pressure fuel rail 250 falls below a threshold pressure. In another example, LPP 208 can be operated in a pulsed mode when DI fuel pump 228 is in the variable pressure mode but LPP 208 may be pulsed at a non-zero voltage only when fuel vapor is detected at inlet 303 of DI fuel pump 228.

It is noted that while pump 228 is shown in FIG. 2 as a symbol with no detail, FIG. 3 shows pump 228 in full detail.

When DI fuel pump 228 is operated in a variable pressure mode, solenoid activated check valve 312 may be energized to regulate pressure continuously throughout DI pump operation in the variable pressure mode. Thus, a continuous range of HP pump pressures (and fuel rail pressures) may be available in between a lower threshold pressure and an upper threshold pressure that may define minimum and maximum allowable pressures. Further, solenoid activated check valve 312 may be adjusted based on fuel rail pressure in the second fuel rail 250.

It is noted here that DI pump 228 of FIG. 3 is presented as an illustrative example of one possible configuration for a DI pump that can be operated in an electronic regulation (or variable pressure) mode as well as in a default pressure or mechanically-regulated mode. Components shown in FIG. 3 may be removed and/or changed while additional components not presently shown may be added to DI fuel pump 228 while still maintaining the ability to deliver high-pressure fuel to a direct injection fuel rail with and without electronic pressure regulation.

Referring now to FIG. 4, an example routine 400 is illustrated for selecting a mode of lift pump operation based on a mode of operation of the DI fuel pump. Specifically, low pressure pump operation may be different when the DI fuel pump is in default pressure mode and when the DI fuel pump is in variable pressure mode. Operation of the LPP, according to the present disclosure, may provide savings in energy consumption by the LPP.

At 402, engine operating conditions may be estimated and/or measured. For example, engine conditions such as engine speed, engine fuel demand, boost, driver demanded torque, engine temperature, air charge, etc. may be determined. At 404, routine 400 may determine if the HPP (e.g. DI fuel pump 228) can be operated in the default pressure mode. The HPP may be operated in default pressure mode, in one example, if the engine is idling. In another example, the HPP may function in default pressure mode if the vehicle is decelerating. If it is determined that DI fuel pump can be operated in default pressure mode, routine 400 progresses to 420 where the solenoid activated check valve (such as SACV 312 of DI pump 228) may be deactivated. To elaborate, the solenoid within the SACV may not receive commands from the controller, and may be deactivated such that fuel may flow upstream from and downstream of SACV. Herein, as explained earlier, the default pressure of DI fuel pump may be determined by a pressure relief valve, such as pressure relief valve 301 of FIG. 3, positioned upstream of the SACV.

At 422, the LPP may be set to zero voltage so that its energy consumption is reduced but it is ready for actuation when commanded. It will be noted that LPP may be pulsed when desired by providing a non-zero voltage to the lift pump. To clarify, the LPP may not be deactivated and may not be shutdown. At 424, readings from a pressure sensor coupled to the high pressure fuel rail (e.g. second fuel rail 250 in fuel system 8 of FIG. 2) may be sampled. In particular, readings collected during a compression stroke of the piston within the DI fuel pump may be investigated. As such, obtaining readings of FRP during the pump compression stroke may be advantageous because when the DI pump is in default pressure mode, pump pressure may be substantially at the default pressure during the entire compression stroke of the piston. During the first part of the compression stroke the fuel rail pressure may be reestablished (following prior injector fuel consumption) and during the last part of the compression stroke, the default pressure may be restored to default level. While FRP readings obtained during any stage of DI pump stroke may be used, it may be more reliable to use pressure readings from towards an end of the compression stroke.

Thus, FRP in the mechanically regulated default pressure mode may be learned, instead of using an a priori pressure, by sampling sensed pressures during compression strokes of the DI fuel pump. In one example, pressure readings from a later portion of the compression stroke may be sampled. It will be appreciated that by sampling pressure readings particularly during the compression stroke of the DI pump, a more reliable pressure reading may be obtained even if a fuel injection is in progress. As such, injector openings during fuel injection may contribute to variability in fuel rail pressure readings. By focusing on pressure readings obtained during the compression stroke in the DI pump, variability in pressure readings due to injector openings during fuel injection may be lowered.

At 426, routine 400 may determine if the sampled FRP readings are lower than a threshold. In one example, an average FRP of the sampled FRP readings may be compared to the threshold. In another example, each FRP reading obtained during the compression strokes may be compared to the threshold. The threshold, in one example, may be the default pressure of the DI fuel pump. As an example, default pressure may be 20 bar which may be a combination (as mentioned earlier) of the regulation pressure (e.g. 15 bar) of pressure relief valve 301 of FIG. 3 and fuel pressure at an exit of the LP pump (e.g. 5 bar). In another example, the threshold may be lower than the default pressure of the DI pump. For example, the threshold may be 13 bar.

If it is confirmed that FRP readings sensed during the compression stroke of the DI fuel pump are at or above the threshold, at 414, LPP may continue to be at zero voltage and routine 400 may end. If, on the other hand, it is determined that FRP readings during the compression stroke are lower than the threshold, routine 400 continues to 428 where LPP may be pulsed at substantially full voltage to increase FRP in the high pressure fuel rail. Optionally, at 430, the LPP may be pulsed for short predetermined durations such as 150 to 250 milliseconds. In one example, the LPP may be pulsed at a non-zero voltage for 250 milliseconds. In another example, the LPP may be pulsed at a distinct non-zero voltage for 200 milliseconds. In yet another example, the LPP may be pulsed at a different non-zero voltage for 150 milliseconds. Next, at 432, the LPP may be returned to zero voltage and routine 400 may end.

Therefore, during default pressure operation of the DI fuel pump, the lift pump or LPP may be pulsed with a full voltage (or a non-zero voltage) only when pressure of the DI pump is mechanically regulated and when FRP in the high pressure fuel rail decreases below the threshold.

Returning to 404, if it is determined that the HPP may not be operated in default pressure mode, routine 400 continues to 406 to operate the HPP in variable pressure mode and at 407 the LPP may be set to zero voltage. Herein, the LPP may be switched ON but may not be actuated. The variable pressure mode of HPP operation may be used during non-idling conditions, in one example. In another example, the variable pressure mode may be used when torque demand is greater, such as during acceleration of a vehicle. As mentioned earlier, variable pressure mode may include controlling HPP operation electronically by actuating the solenoid activated check valve and regulating fuel pressure continuously. Accordingly, at 408, the solenoid activated check valve may be adjusted to regulate FRP in the high pressure fuel rail. Further, at 410, routine 400 may include receiving feedback from the pressure sensor coupled to the high pressure fuel rail.

At 412, it may be determined if fuel vapor is present at the inlet of DI fuel pump. As such, presence of fuel vapor may be detected by variations in FRP in the high pressure fuel rail. Routine 500 of FIG. 5 illustrates the detection of fuel vapor at the inlet of the DI fuel pump and will be described later. As such, when the DI fuel pump ingests fuel in the form of vapor instead of liquid, its volumetric efficiency decreases. Volumetric efficiency may be continuously monitored with dynamic inputs of fuel rail pressure, DI pump command, DI pump speed, and fuel injection flow rate.

If it is determined that fuel vapor is not present at the DI fuel pump inlet, routine 400 continues to 414 to maintain the LPP at zero voltage. Else, at 416, the LPP may be pulsed at, or substantially at, full voltage to increase fuel volume at the inlet of the DI pump. Optionally, at 418, the LPP may be pulsed for short durations, e.g. 150-250 milliseconds. Routine 400 may then end.

Therefore, during variable pressure operation of the DI fuel pump, the lift pump or LPP may be pulsed with a full voltage (or a non-zero voltage) only when pressure of the DI pump is electronically regulated and when fuel vapor is detected at the DI pump inlet.

Thus, an example method of lift pump operation may comprise, during default pressure operation of a direct injection pump, disabling a solenoid activated check valve, and pulsing a lift pump responsive to a decrease in fuel rail pressure below a threshold, and during variable pressure operation of the direct injection pump, enabling the solenoid activated check valve, and pulsing the low pressure pump responsive to a condition other than the decrease in fuel rail pressure below the threshold. Disabling the solenoid activated check valve may include deactivating the solenoid activated check valve to provide a fuel flow-through mode. Thus, fuel may flow either upstream or downstream of the solenoid activated check valve. Enabling the solenoid activated check valve may include enabling it from deactivation such that the solenoid within the solenoid activated check valve is energized and de-energized in response to commands from the controller.

The method may include pulsing the low pressure pump during variable pressure operation responsive to a condition when fuel vapor is detected at an inlet to the direct injection pump. Further, pulsing the lift pump during default pressure operation of the direct injection pump may be in response to the decrease in fuel rail pressure when measured during a compression stroke in the direct injection pump. In one example, the method may include pulsing the low pressure pump at full voltage or substantially full voltage. In another example, the low pressure pump may be pulsed for predetermined durations at a specified level of electrical power, voltage, or current. Furthermore, during variable pressure operation of the direct injection pump, the solenoid activated check valve may be adjusted responsive to changes in fuel rail pressure wherein the changes in fuel rail pressure are measured by a pressure sensor.

Turning now to FIG. 5, routine 500 is depicted to illustrate the detection of fuel vapor at an inlet of a DI fuel pump. Specifically, changes in FRP are measured and if an expected increase in FRP is not observed, presence of fuel vapor may be determined.

At 502, routine 500 includes determining if the solenoid activated check valve (SACV) is operating at 100% duty cycle. A 100% duty cycle may include closing the SACV at the beginning of the compression stroke of the piston in the DI fuel pump so that, substantially 100% of the fuel is compressed in the pump. By ensuring a 100% duty cycle, fuel vapor detection may be more reliably performed because the SACV can be actuated before the pump piston reaches BDC. By actuating the SACV before the piston reaches BDC position, smaller errors in actuation angle may not reduce or increase the effective displacement. If it is confirmed that the SACV is not being operated at 100% duty cycle, routine 500 proceeds to 504 to wait to determine the presence of fuel vapor. Routine 500 then ends.

If it is confirmed that the SACV is operating at 100% duty cycle, routine 500 continues to 506 to determine if a change in measured FRP (ΔFRP_measured) after a compression stroke in the DI fuel pump is equal to (or greater) than an expected rise in FRP (ΔFRP_expected). Every piston stroke of the DI fuel pump may increase FRP by a given amount. To elaborate, FRP in the high pressure fuel rail may be projected to increase by an expected amount, particularly when the duty cycle is 100%. If the increase in FRP after a pump stroke (excluding a drop on FRP due to fuel injection, if injection occurs) is less than the expected amount, it may be determined that fuel vapor is present at the pump inlet.

If, at 506, it is determined that ΔFRP_measured is equal to or greater than ΔFRP_expected, routine 500 progresses to 508 where it may determine that fuel vapor is not present at the HPP inlet. On the other hand, if it is determined that ΔFRP_measured is lower than ΔFRP_expected, at 512, routine 500 may determine that fuel vapor is present at the HPP inlet.

Thus, presence of fuel vapor at an inlet of the HPP may be determined by measuring a change in fuel rail pressure in the high pressure fuel rail after a compression stroke in the DI fuel pump. Further, the determination of fuel vapor at the inlet may be more reliable when the DI fuel pump is commanded at full pump strokes (e.g. 100% duty cycle). Full pump strokes may include commanding the closing of the SACV to coincide with the beginning of the compression stroke in the DI fuel pump.

Turning now to FIG. 6, it illustrates map 600 depicting an example operation of the lift pump based on an operating mode of the DI fuel pump in an example engine in a vehicle. Map 600 shows fuel vapor detection at DI pump inlet at plot 602, FRP in the high pressure or direct injection fuel rail at plot 604, DI pump stroke at plot 606, duty cycle of the HPP and operation of SACV at plot 608, fuel injected via direct injection at plot 610, HP pump operation mode (options of variable and default pressure modes) at plot 612, and LPP operation at plot 614. All the above are plotted against time on the X-axis and time increases along the X-axis from left to right of the map 600. Further, line 605 represents a threshold pressure for FRP in the high pressure rail.

Between t0 and t1, the HPP may be operating in the variable pressure mode and the SACV may be activated and operational so that pressure of the HPP is electronically regulated. As shown in plot 608, the HPP may be set at 50% duty cycle wherein the SACV may be closed at or about when the piston in the DI fuel pump is midway through its compression stroke. The SACV may be controlled to operate the DI pump at different duty cycles based on a desired FRP in the high pressure fuel rail. Plot 606 depicts the strokes of the HPP as it cycles between top dead center (TDC) and bottom dead center (BDC) positions. The LPP may be set at zero voltage between t0 and t1 enabling it to be operated in a pulsed mode when a change in FRP is demanded. Further, between t0 and t1, fuel may be injected via direct injectors (plot 610) into one or more cylinders of the example engine herein. In response to each injection, FRP may decrease as shown in plot 604. It will be observed that FRP in the direct injection rail increases as the HP pump stroke moves from BDC to TDC.

At t1, DI fuel pump operation may be transitioned to default pressure mode. For example, the change in DI pump operation may be in response to engine idling conditions. In another example, the vehicle may be descending an incline and consequently, DI pump operation may be changed to default pressure mode. Further, the SACV may be deactivated (plot 608) to operate in the pass-through mode wherein fuel may flow through the SACV either in an upstream or downstream direction. Thus, the SACV may no longer function as a check valve and the default pressure of the DI pump may be regulated by the pressure relief valve located upstream of the SACV.

In response to the change in DI fuel pump mode, fuel injected via the direct injectors may be reduced as shown between t1 and t3 in plot 610. At t2, after an injection, FRP in the high pressure rail may fall below threshold pressure 605. Accordingly, the lift pump may be pulsed at full voltage at t2 (plot 614) to increase fuel pressure in the DI fuel rail (plot 604) to above threshold pressure 605.

At t3, torque demand may increase and DI fuel pump operation may be returned to the variable pressure mode and accordingly, the SACV may be activated. Further, pressure in the high pressure fuel rail may be controlled by adjusting the SACV. At t3, HP pump duty cycle may be 50% as shown by plot 608, and direct injected fuel quantities may increase after t3.

At t4, FRP in the direct injection fuel rail may decrease below threshold pressure 605. Since the DI fuel pump is operating in variable pressure mode, the duty cycle of the HP pump may be increased in response to this drop in FRP. Accordingly, full pump strokes may be commanded at t4 by increasing HP pump duty cycle to 100%. Herein, a closing time of the SACV may coincide with a beginning of the compression stroke in the DI fuel pump. As a result of the increase in duty cycle, FRP may increase to above the threshold pressure 605 at t5 and fuel injected via direct injectors may increase after t4.

It will be appreciated that the LPP may not be pulsed in response to the drop in FRP below threshold pressure 605 at t4 when the DI fuel pump is in the variable pressure mode.

At t5, in response to the compression stroke of the HP pump operating at 100% duty cycle, FRP may increase by an amount represented by D1 in map 600. Herein, D1 may be equal to an expected rise in FRP resulting from a pump compression stroke when at 100% duty cycle. At t6, the increase in FRP resulting from a subsequent compression stroke when the HP pump is at 100% duty cycle is D2. As will be noted, D2 is smaller than D1 and therefore, D2 is lower than the expected increase in FRP resulting from a pump compression stroke when at 100% duty cycle. Therefore, it may be determined, at t6, that fuel vapor is present at the inlet of the HP pump (plot 602). In response to the indication of fuel vapor presence at the HP pump inlet, the lift pump may be pulsed at t7 to increase the available fuel and fuel pressure upstream of the SACV. Accordingly, at t8, the increase in FRP in the high pressure fuel rail with the compression stroke may be the expected increase of D1, and plot 602 may not indicate the presence of fuel vapor at t8.

Thus, the lift pump may be operated at a non-zero voltage intermittently enabling a reduction in power consumption. Further, the lift pump may be energized at the non-zero voltage in response to a drop in FRP below a threshold pressure when the DI fuel pump is in a default pressure mode. Further still, the FRP in the mechanically regulated default pressure mode may be learned, instead of using an a priori pressure, by sampling sensed pressures during compression strokes of the DI fuel pump. When the DI fuel pump is electronically controlled and the SACV is activated, the lift pump may be pulsed only when fuel vapor is detected at an inlet of the DI fuel pump. Presence of fuel vapor at the DI fuel pump inlet may be confirmed when a measured increase in FRP after a pump stroke is less than an expected increase in FRP. As such, the lift pump may not be pulsed in response to a drop in FRP below the threshold pressure when the DI fuel pump is operating in variable pressure mode.

Therefore, a method of operating a lift pump may include a distinct mode of operation when the high pressure pump is in default mode from when the high pressure pump is in variable pressure mode. The method may comprise, when operating a high pressure pump in a default pressure mode, pulsing a low pressure pump when pressure in a high pressure fuel rail decreases below a threshold, and when operating the high pressure pump in a variable pressure mode, pulsing the low pressure pump based on presence of fuel vapor at an inlet of the high pressure pump. Herein, an electronically-controlled solenoid valve (or the SACV) may be deactivated when the high pressure pump is operated in default pressure mode. As such, the SACV may not receive any commands from a controller in this default pressure mode and the solenoid within the SACV may not be alternated between an energized and a de-energized position. The electronically-controlled solenoid valve may be activated when the high pressure pump is operated in variable pressure mode, and the pressure in the high pressure fuel rail may be regulated via the electronically-controlled solenoid valve. The method may further comprise not pulsing the low pressure pump when pressure in the high pressure fuel rail decreases below the threshold when operating the high pressure pump in variable pressure mode. Further still, when operating the high pressure pump in the variable pressure mode, presence of fuel vapor at the inlet of the high pressure pump may be determined when an increase in pressure in the high pressure fuel rail during a pump stroke is less than an expected increase. Furthermore, pressure in the high pressure fuel rail may be measured via a fuel rail pressure sensor, and the low pressure pump may be pulsed based on a measurement of pressure during a compression stroke in the high pressure pump.

Thus, an example system may include a port fuel direct injection (PFDI) engine with a direct injection fuel pump including a piston, compression chamber, a cam for moving the piston, a solenoid activated check valve positioned at an inlet of the direct injection fuel pump, and a pressure relief valve positioned upstream of the solenoid activated check valve for regulating pressure in the compression chamber during a default pressure mode. The example system may further include a high pressure fuel rail fluidically coupled to the direct injection pump, a sensor coupled to the high pressure fuel rail for monitoring fuel rail pressure, and a lift pump fluidically coupled to the high pressure fuel rail via the direct injection pump. Further still, the system may comprise a controller having executable instructions stored in a non-transitory memory for, during a first condition, pulsing the lift pump based on a decrease in pressure in the high pressure fuel rail below a threshold, and during a second condition, pulsing the lift pump based on detection of fuel vapor at an inlet of the direct injection pump. The first condition may include operation of the direct injection pump in the default pressure mode by deactivating the solenoid activated check valve, and wherein a default pressure of the direct injection pump is determined by the pressure relief valve positioned upstream of the solenoid activated check valve. The second condition may include operation of the direct injection pump in a variable pressure mode, wherein the solenoid activated check valve is activated and adjusted based on the fuel rail pressure in the high pressure fuel rail. Further, during the second condition, the lift pump may not be pulsed when fuel pressure in the high pressure fuel rail decreases below the threshold. Further still, fuel vapor at the inlet of the direct injection pump may be detected when a measured change in fuel rail pressure of the high pressure fuel rail during a compression stroke of the direct injection pump is lower than an expected change in fuel rail pressure.

In this way, a lift pump in a PFDI engine may be controlled when it is supplying a DI fuel pump. The lift pump may be primarily set to a zero voltage operation and actuated with a non-zero voltage only when certain conditions are met. Thus, energy consumption by the lift pump may be lowered enabling a reduction in fuel consumption. Further, actuation of the lift pump may be based on fuel rail pressure measurements during compression strokes in the DI fuel pump. Fuel rail pressures during the compression stroke may not be affected by an open fuel injector. Therefore, a more reliable and repeatable measurement of fuel rail pressure may be obtained, enabling improved lift pump control. Overall, by enhancing operation of the lift pump, pump durability and performance may be improved.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

when operating a high pressure pump in a default pressure mode with an electronically-controlled solenoid valve deactivated and direct injecting fuel via injectors of a high pressure fuel rail, pulsing a low pressure pump when pressure in the high pressure fuel rail decreases below a threshold; and when operating the high pressure pump in a variable pressure mode with the electronically-controlled solenoid valve activated, pulsing the low pressure pump based on presence of fuel vapor at an inlet of the high pressure pump.

2. The method of claim 1, wherein pulsing the low pressure pump based on presence of fuel vapor includes pulsing the lower pressure pump between a zero voltage and a non-zero voltage only when fuel vapor is detected, and otherwise maintaining the low pressure pump at a zero voltage, and wherein pulsing the low pressure pump when pressure in the high pressure fuel rail decreases below the threshold includes pulsing the low pressure pump between a zero voltage and a non-zero voltage only when pressure in the high pressure fuel rail decreases below the threshold.

3. The method of claim 1, wherein the high pressure pump is operated in the variable pressure mode, and wherein the pressure in the high pressure fuel rail is regulated via the electronically-controlled solenoid valve.

4. The method of claim 3, wherein pulsing the low pressure pump includes pulsing the low pressure pump at full voltage, and wherein during the default pressure mode the high pressure pump is operated with a constant default pressure.

5. The method of claim 1, wherein pulsing the low pressure pump includes pulsing the low pressure pump for durations between 150-250 milliseconds.

6. The method of claim 1, further comprising, when operating the high pressure pump in the variable pressure mode, not pulsing the low pressure pump when pressure in the high pressure fuel rail decreases below the threshold.

7. The method of claim 1, wherein when operating the high pressure pump in the variable pressure mode, presence of fuel vapor at the inlet of the high pressure pump is determined when an increase in pressure in the high pressure fuel rail during a pump stroke is less than an expected increase.

8. The method of claim 1, wherein pressure in the high pressure fuel rail is measured via a fuel rail pressure sensor, and wherein the low pressure pump is pulsed based on a measurement of pressure during a compression stroke in the high pressure pump.

9. A system, comprising:

a port fuel direct injection (PFDI) engine;

a direct injection fuel pump including a piston, a compression chamber, a cam for moving the piston, a solenoid activated check valve positioned at an inlet of the direct injection fuel pump, and a pressure relief valve positioned upstream of the solenoid activated check valve for regulating pressure in the compression chamber during a default pressure mode;

a high pressure fuel rail fluidically coupled to the direct injection fuel pump;

a sensor coupled to the high pressure fuel rail for monitoring fuel rail pressure;

a lift pump fluidically coupled to the high pressure fuel rail via the direct injection fuel pump; and a controller having executable instructions stored in a non-transitory memory for:

during a first condition, pulsing the lift pump between zero voltage and a non-zero voltage only based on a decrease in pressure in the high pressure fuel rail below a threshold and otherwise maintaining the lift pump at zero voltage; and during a second condition, pulsing the lift pump between zero voltage and a non-zero voltage only based on detection of fuel vapor at an inlet of the direct injection fuel pump, and otherwise maintaining the lift pump at zero voltage, wherein the first condition includes operation of the direct injection fuel pump in the default pressure mode by deactivating the solenoid activated check valve, and wherein a default pressure of the direct injection fuel pump is determined by the pressure relief valve positioned upstream of the solenoid activated check valve.

10. The system of claim 9, wherein the second condition includes operation of the direct injection fuel pump in a variable pressure mode, and wherein the solenoid activated check valve is activated and adjusted based on the pressure in the high pressure fuel rail.

11. The system of claim 10, wherein during the second condition, the lift pump is not pulsed when pressure in the high pressure fuel rail decreases below the threshold.

12. The system of claim 10, wherein fuel vapor at the inlet of the direct injection fuel pump is detected when a measured change in pressure of the high pressure fuel rail during a compression stroke of the direct injection fuel pump is lower than an expected change in pressure of the high pressure fuel rail.

* * * * *